US011807017B2

(12) United States Patent
Yoshida

(10) Patent No.: US 11,807,017 B2
(45) Date of Patent: Nov. 7, 2023

(54) LIQUID EJECTION APPARATUS

(71) Applicant: CANON KABUSHIKI KAISHA, Tokyo (JP)

(72) Inventor: Masato Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 17/499,701

(22) Filed: Oct. 12, 2021

(65) Prior Publication Data

US 2022/0111658 A1 Apr. 14, 2022

(30) Foreign Application Priority Data

Oct. 14, 2020 (JP) ..... 2020-172977
Aug. 2, 2021 (JP) ..... 2021-126678

(51) Int. Cl.
*B41J 2/175* (2006.01)

(52) U.S. Cl.
CPC .. *B41J 2/17566* (2013.01); *B41J 2002/17573* (2013.01)

(58) Field of Classification Search
CPC ..... B41J 2/17566; B41J 2002/17573
See application file for complete search history.

(56) References Cited

U.S. PATENT DOCUMENTS

2005/0195225 A1* 9/2005 Takagi ..... B41J 2/17546 347/7
2008/0239038 A1* 10/2008 Yoshimoto ..... B41J 2/17566 347/86

FOREIGN PATENT DOCUMENTS

JP H11138842 A 5/1999

* cited by examiner

*Primary Examiner* — Sharon Polk
(74) *Attorney, Agent, or Firm* — Canon U.S.A., Inc. I.P. Division

(57) ABSTRACT

Provided is a liquid ejection apparatus including an ink cartridge including a first ink storage section which stores ink; an ink tank including a second ink storage section which is connected to the ink cartridge and supplied with ink from the ink cartridge; and a detection unit including a light emitting section which emits detection light and a light receiving section which receives the detection light, in which the ink cartridge includes a first protrusion in communication with the first ink storage section, the ink tank includes a recess and a second protrusion in communication with the second ink storage section, the light emitting section and the light receiving section are arranged in the recess, and the first protrusion and the second protrusion are arranged between the light emitting section and the light receiving section.

10 Claims, 9 Drawing Sheets

LIQUID EJECTION APPARATUS

BACKGROUND

Field of the Disclosure

The present disclosure relates to a liquid ejection apparatus that ejects liquid.

Description of the Related Art

A liquid ejection apparatus is known which includes an ink cartridge that stores a liquid such as ink, an ink tank that is connected to the ink cartridge and supplied with ink from the ink cartridge, and an ink ejection head that ejects the ink in the ink tank. The ink tank is connected to the ink ejection head via a tube. An inkjet device is an example of a liquid ejection apparatus. In this liquid ejection apparatus, when the liquid in the ink tank runs out, the liquid cannot be ejected. Therefore, it is necessary to have a detection unit to detect the presence or absence of liquid in the ink cartridge or ink tank.

Japanese Patent No. 3530727 describes a recording device which includes a recording head and an ink tank for supplying ink to the recording head, both mounted on a carriage. On the bottom of the ink tank, an optical prism is provided to detect the presence or absence of ink. An optical unit (detection unit for detecting the presence or absence of liquid) including a light emitting section and a light receiving section is arranged at a position facing the bottom surface of the ink tank on the path traversed by the carriage. When the carriage passes over the optical unit, the light emitting section irradiates the optical prism with light. The light receiving section receives the reflected light from the optical prism. Based on the light receiving result, the presence or absence of ink can be detected.

In the recording device described in Japanese Patent No. 3530727, a single detection unit can only detect the presence or absence of ink in the ink tank. Specifically, if the presence or absence of ink in the ink cartridge is to be detected as well, a separate detection unit for the ink cartridge must be prepared, which increases the cost of the liquid ejection apparatus. In addition, if a detection unit for the ink cartridge is prepared, the size of the liquid ejection apparatus will be increased accordingly.

SUMMARY

One aspect of the present disclosure is to detect the presence or absence of ink in both the ink tank and the ink cartridge with a single detection unit. As a result, it is possible to suppress the cost increase and the size increase of the liquid ejection apparatus.

The present disclosure is a liquid ejection apparatus including an ink cartridge including a first ink storage section which stores ink; an ink tank including a second ink storage section which is connected to the ink cartridge and supplied with ink from the ink cartridge; and a detection unit including a light emitting section which emits detection light and a light receiving section which receives the detection light, in which the ink cartridge includes a first protrusion in communication with the first ink storage section, the ink tank includes a recess and a second protrusion in communication with the second ink storage section, the light emitting section and the light receiving section are arranged in the recess, and the first protrusion and the second protrusion are arranged between the light emitting section and the light receiving section.

Further features of the present disclosure will become apparent from the following description of exemplary embodiments with reference to the attached drawings.

DESCRIPTION OF THE EMBODIMENTS

First Embodiment

Figure 1:
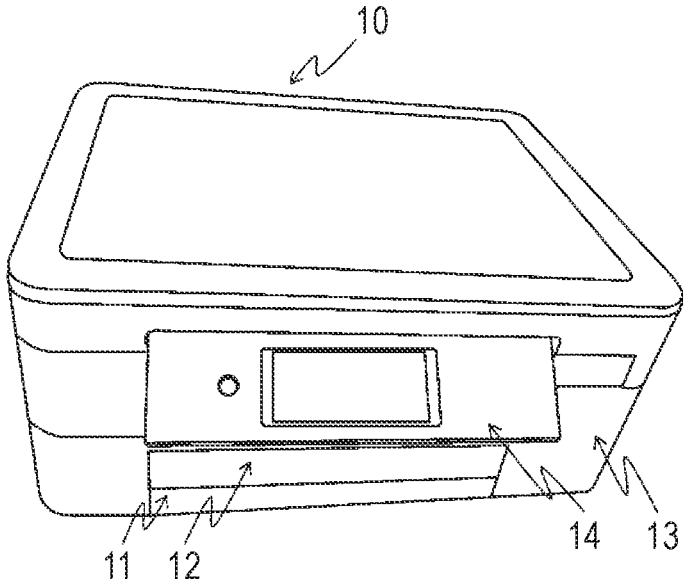
FIG. 1 is a schematic view showing the appearance of the liquid ejection apparatus according to the first embodiment of the present disclosure.

FIG. 1 is a schematic view showing the appearance of the liquid ejection apparatus according to the first embodiment of the present disclosure. The liquid ejection apparatus 10 shown in FIG. 1 includes a charging unit 11, a discharging unit 12, a liquid storage unit 13, and an operation panel unit 14. The charging unit 11 loads a print medium such as paper. The discharging unit 12 discharges the printed matter. The liquid storage unit 13 stores a liquid such as ink. The operation panel unit 14 accepts input operations such as printing operations. This liquid ejection apparatus 10 can be called a so-called inkjet recording device.

Figure 2:
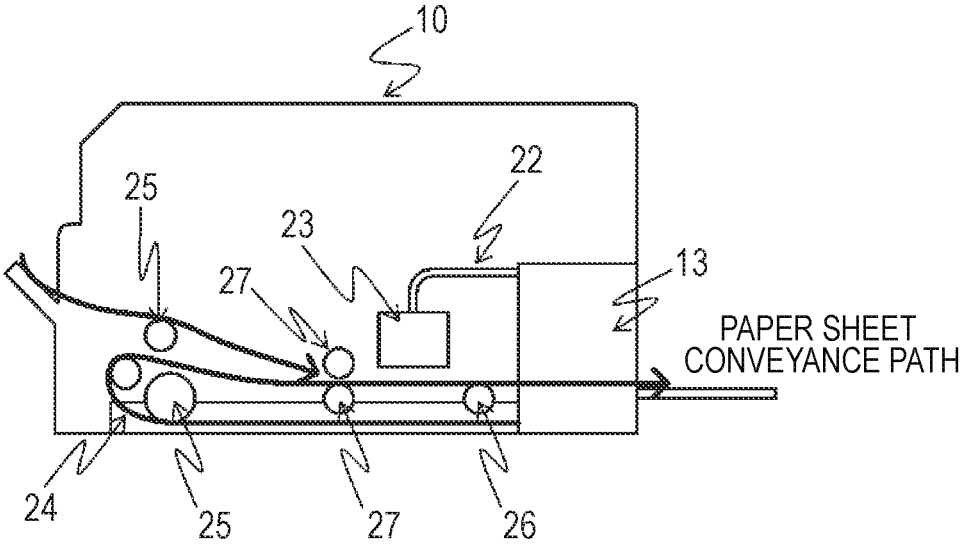
FIG. 2 is a schematic view showing the main structure of the recording part of the liquid ejection apparatus shown in FIG. 1.

Next, the structure of the recording part of the liquid ejection apparatus 10 will be described. FIG. 2 is a schematic view showing the main structure of the recording part of the liquid ejection apparatus 10. The liquid ejection apparatus 10 includes a cassette 24, a paper feed roller 25, a paper discharge roller 26, a positioning roller 27, a recording head 23, a liquid tube 22, and a liquid storage unit 13.

The cassette 24 is a box-shaped container, and can store a stack of recording paper sheets as a print medium. The cassette 24 is provided with a sliding mechanism that can be moved horizontally in and out of the main body of the liquid ejection apparatus 10. The cassette 24 is pulled out, and paper sheets are loaded. After loading the paper sheets, the cassette 24 is pushed in. Inside the cassette 24, movable guides are installed at two locations in the width direction and the depth direction. Even when storing paper sheets of different sizes such as A4 size and postcard size, it is possible to use the guides to align the paper sheets with the center as a reference.

The paper feed roller 25 is provided in each of the charging section 11 and the cassette 24. When the paper feed roller 25 rotates, the recording paper sheets stored in the cassette 24 can be picked up one by one. Similarly, in the charging unit 11, when the paper feed roller 25 rotates, the recording paper sheets can be picked up one by one. The rotation speed of the paper feed roller 25 is adjustable. A rubber having a wavy shape called an elephant skin is wrapped around the contact surface of the paper feed roller 25 with the paper sheet. The recording paper sheet picked up by the paper feed roller 25 heads toward the positioning roller 27.

The positioning roller 27 conveys the recording paper sheets conveyed from the paper feed roller 25 toward the recording head 23. Here, two rollers are provided on the upper and lower sides, and the recording paper sheet is sandwiched between these rollers. One of the rollers is rotated by a motor, and the other roller is driven to rotate. The recording paper sheet is sandwiched between the upper and lower rollers and conveyed with high precision so that the distance between the recording head 23 and the recording paper sheet is maintained within a certain range. Friction between the surface of each roller and the recording paper sheet is important to achieve high-precision conveyance. The surface of the rollers is covered with, for example, a paint containing ceramic particles.

The recording head 23 prints on the recording paper sheet by discharging droplets while moving in a direction orthogonal to the conveyance direction of the recording paper sheet. For example, it is possible to record an image based on a document or image data provided by a personal computer (not shown) or the like on a recording paper sheet. The recording paper sheet that has passed through the recording head 23 heads toward the paper discharge roller 26. The paper discharge roller 26 discharges the recording paper sheet that has passed through the recording head 23 to the outside of the liquid ejection apparatus 10.

The liquid storage unit 13 supplies the liquid to the recording head 23 via the liquid tube 22. When supplying liquids of multiple colors to the recording head 23, a liquid tube 22 is provided for each color of the liquid. The liquid tube 22 has a sufficient length so as not to limit the movable range of the recording head 23.

Figure 3:
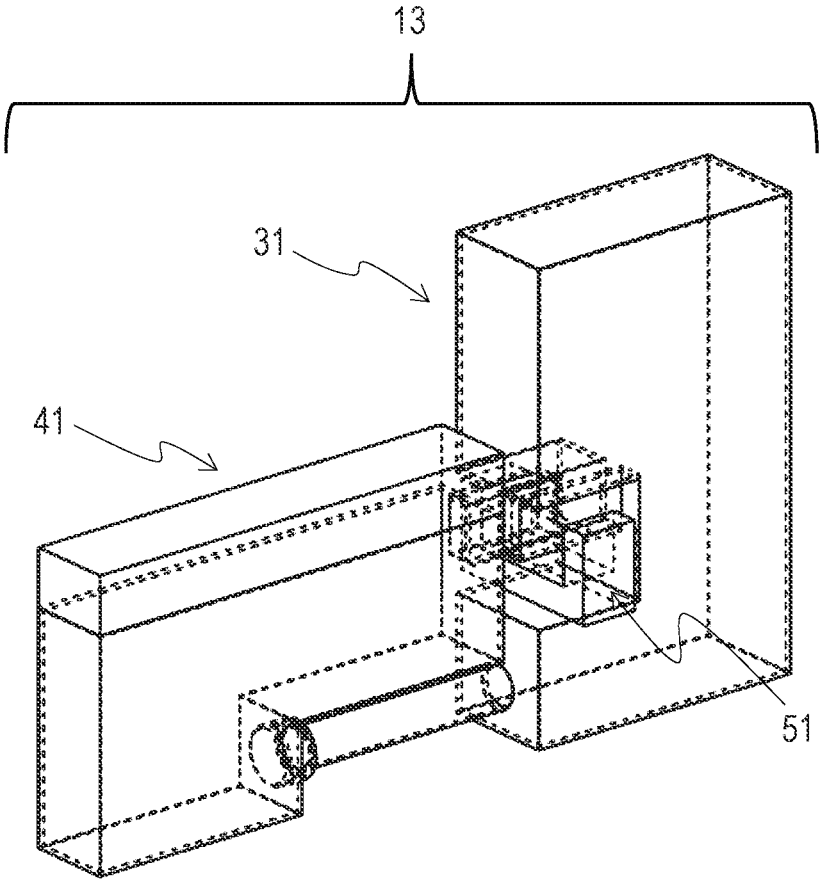
FIG. 3 is a perspective view schematically showing an overall configuration of a liquid storage unit.

Hereinafter, the configuration of the liquid storage unit 13 will be described with reference to the drawings. FIG. 3 shows an overall configuration of the liquid storage unit 13. The liquid storage unit 13 includes an ink cartridge 41 that stores a liquid such as ink, an ink tank 31 that is connected to the ink cartridge 41 and supplied with liquid from the ink cartridge 41, and an optical sensor 51. The optical sensor 51 can detect the presence or absence of liquid in the ink tank 31 and the presence or absence of liquid in the ink cartridge 41. The ink tank 31, the ink cartridge 41, and the optical sensor 51 are provided for each color of the liquid. The liquid of each color has a property of absorbing or reflecting the light for detection used in the optical sensor 51 (hereinafter referred to as detection light).

Figure 4:
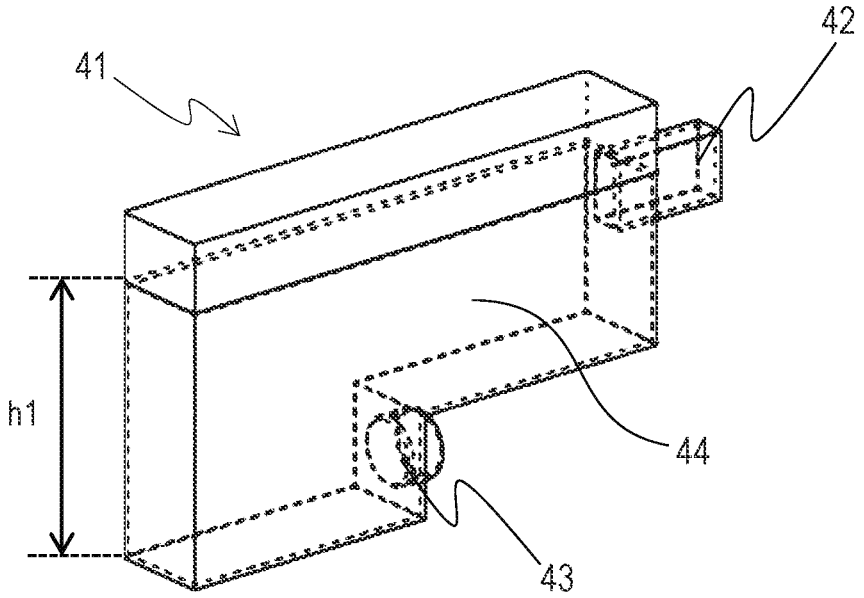
FIG. 4 is a perspective view schematically showing the configuration of the ink cartridge.

FIG. 4 shows the configuration of the ink cartridge 41. The ink cartridge 41 includes a first ink storage section 44 which stores ink, a first protrusion 42, and a liquid discharging port 43. With the ink cartridge 41 connected to the ink tank 31, the liquid stored in the ink cartridge 41 is supplied to the ink tank 31 via the liquid discharging port 43. The first protrusion 42 is inserted into the recess in the ink tank 31. Since the first protrusion 42 communicates with the first ink storage section 44, when the ink cartridge 41 is filled with ink, the ink is also stored in the first protrusion 42.

The first protrusion 42 is a member that is transparent to the detection light used by the optical sensor 51. The first protrusion 42 includes a space communicating with a space for storing the liquid in the ink cartridge 41. The height from the bottom of the ink cartridge 41 to the upper end of the first protrusion 42 is h1. If the liquid surface level in the ink cartridge 41 exceeds the height h1, the first protrusion 42 is filled with the liquid. The liquid surface level in the first protrusion 42 matches the liquid surface level in the ink cartridge 41.

Figure 5:
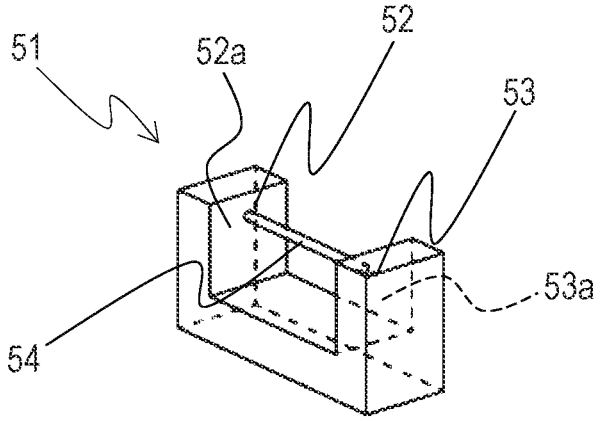
FIG. 5 is a perspective view schematically showing the configuration of the optical sensor.

FIG. 5 shows the configuration of the optical sensor 51. The optical sensor 51 includes a light emitting section 52 which emits detection light and a light receiving section 53 that is arranged so as to face the light emitting section 52 and receives the detection light, and outputs a signal indicating whether or not the detection light is received. The optical sensor 51 is a concave member which includes a first side surface 52*a* provided with the light emitting section 52 and a second side surface 53*a* facing the first side surface 52*a* and provided with the light receiving section 53. The light emitting section 52 and the light receiving section 53 are arranged in the recess of the ink tank 31.

The detection light emitted by the light emitting section 52 travels along the optical path 54 and reaches the light receiving section 53. The output signal of the optical sensor 51 becomes a first signal level in the state where the light receiving section 53 is receiving the detection light, and becomes a second signal level in the state where the light receiving section 53 is not receiving the detection light. The state where the light receiving section 53 is not receiving the detection light is, for example, a state where the detection light traveling in the optical path 54 is blocked by a certain unit. Here, the first signal level indicates an ON state, and the second signal level indicates an OFF state.

Figure 6A:
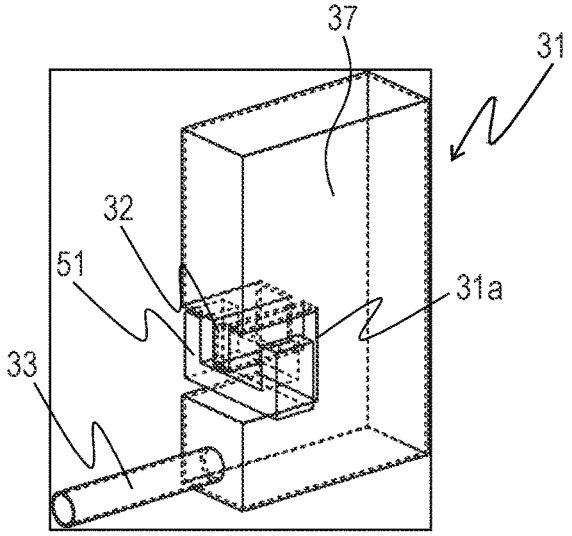
FIGS. 6A and 6B are each a perspective view schematically showing the configuration of the ink tank.
Figure 6B:
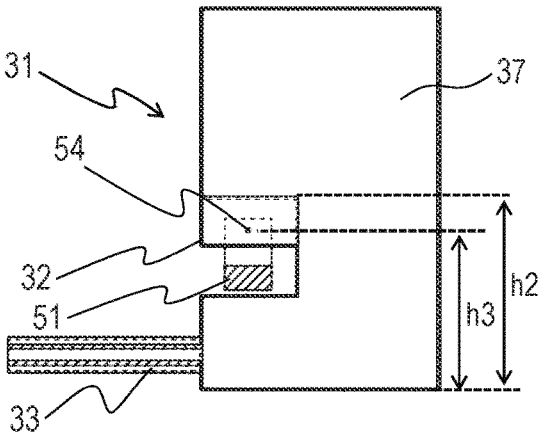

FIGS. 6A and 6B are each a view for explaining the configuration of the ink tank 31. FIG. 6A is a perspective view of the ink tank 31. FIG. 6B is a front view of the ink tank 31.

As shown in FIGS. 6A and 6B, the ink tank 31 includes a second ink storage section 37 which stores ink, a recess 31*a*, a second protrusion 32, and a flow path 33. The ink tank 31 is connected to the ink cartridge 41 with the first protrusion 42 of the ink cartridge 41 inserted into the recess 31*a*. With the ink cartridge 41 and the ink tank 31 connected together, the liquid discharging port 43 of the ink cartridge 41 comes into contact with the flow path 33 of the ink tank 31, and the liquid in the ink cartridge 41 flows into the ink tank 31. The recess 31*a* can store the optical sensor 51 being a concave member. The second protrusion 32 is a part of the ink tank 31. That is, the second protrusion 32 communicates with the second ink storage section 37, and when the ink tank 31 is filled with ink, the ink is also stored in the second protrusion 32.

The second protrusion 32 is a member that is transparent to the detection light used by the optical sensor 51. The second protrusion 32 protrudes from the inner surface of the recess 31*a* so as to intersect the optical path 54 of the optical sensor 51. As described above, the second protrusion 32 and the space (second ink storage section 37) for storing the liquid in the ink tank 31 communicate with each other. Therefore, the liquid in the ink tank 31 flows into the space inside the second protrusion 32. The liquid surface level in the second protrusion 32 matches the liquid surface level in the ink tank 31. The height from the bottom of the ink tank 31 to the top of the second protrusion 32 is h2. If the liquid surface level in the ink tank 31 is the height h2 or higher, the second protrusion 32 is filled with the liquid.

The height from the bottom of the ink tank 31 to the optical path 54 is h3. The liquid has a property of absorbing or reflecting the detection light emitted by the light emitting section 52. Therefore, when the liquid surface level in the ink tank 31 is the height h3 or higher, the detection light is blocked by the liquid in the second protrusion 32. When the liquid surface level in the ink tank 31 is less than the height h3, the detection light passes through the second protrusion 32. Here, the height h3 is an example of a predetermined height.

With the ink cartridge 41 and the ink tank 31 connected together, the first protrusion 42 and the second protrusion 32 are arranged in parallel on the optical path 54 of the optical sensor 51. The first protrusion 42 and the second protrusion 32 are arranged in parallel in a direction orthogonal to the insertion direction of the ink cartridge 41 and orthogonal to the vertical direction. The first protrusion 42 is arranged closer to the light emitting section 52 than the second protrusion 32.

When the liquid surface in the second protrusion 32 is located above the optical path 54, the detection light emitted by the light emitting section 52 is blocked by the liquid in the second protrusion 32. When the liquid surface in the second protrusion 32 is located below the optical path 54, the detection light emitted by the light emitting section 52 passes through the second protrusion 32 and enters the light receiving section 53. Similarly, when the liquid surface in the first protrusion 42 is located above the optical path 54, the detection light emitted by the light emitting section 52 is blocked by the liquid in the first protrusion 42. When the liquid surface in the first protrusion 42 is located below the optical path 54, the detection light emitted by the light emitting section 52 passes through the first protrusion 42.

FIGS. 7A to 7D schematically show passing and blocking states of the detection light in the optical sensor 51. The operation of the optical sensor 51 will be described in detail below with reference to FIGS. 7A to 7D.

Figure 7A:
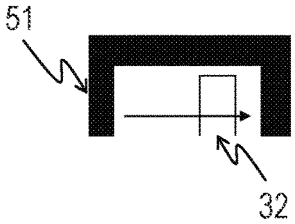
FIGS. 7A, 7B, 7C, and 7D are each a schematic view for explaining the passing and blocking states of the detection light in the optical sensor.

FIG. 7A shows a state where the ink cartridge 41 is not connected to the ink tank 31. Only the second protrusion 32 of the ink tank 31 is arranged in the optical path 54, and the first protrusion 42 of the ink cartridge 41 is not arranged. There is no liquid in the second protrusion 32. In this case, the detection light emitted by the light emitting section 52 passes through the second protrusion 32 and enters the light receiving section 53. The optical sensor 51 outputs a signal indicating the ON state.

Figure 7B:
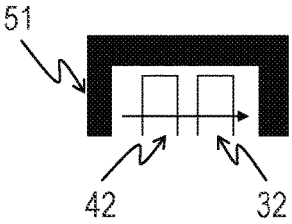

FIG. 7B shows a state where the ink cartridge 41 is connected to the ink tank 31, and the second protrusion 32 of the ink tank 31 and the first protrusion 42 of the ink cartridge 41 are arranged in the optical path 54. There is no liquid in the second protrusion 32. Similarly, there is no liquid in the first protrusion 42. In this case, the detection light emitted by the light emitting section 52 passes through the first protrusion 42 and the second protrusion 32 in order and enters the light receiving section 53. The optical sensor 51 outputs a signal indicating the ON state.

Figure 7C:
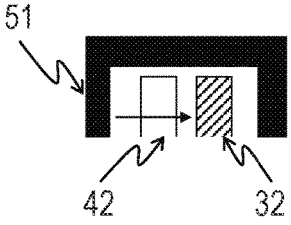

FIG. 7C shows a state where the ink cartridge 41 is connected to the ink tank 31, and the second protrusion 32 of the ink tank 31 and the first protrusion 42 of the ink cartridge 41 are arranged in the optical path 54. There is a liquid in the second protrusion 32, but there is no liquid in the first protrusion 42. In this case, the detection light emitted by the light emitting section 52 passes through the first protrusion 42 and is then blocked by the liquid in the second protrusion 32. The optical sensor 51 outputs a signal indicating the OFF state.

Figure 7D:
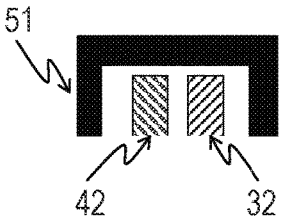

FIG. 7D shows a state where the ink cartridge 41 is connected to the ink tank 31, and the second protrusion 32 of the ink tank 31 and the first protrusion 42 of the ink cartridge 41 are arranged in the optical path 54. There is a liquid in the second protrusion 32. Similarly, there is also a liquid in the first protrusion 42. In this case, the detection light emitted by the light emitting section 52 is blocked by the liquid in the first protrusion 42. The optical sensor 51 outputs a signal indicating the OFF state.

Next, the liquid detection operation of the liquid ejection apparatus of the present embodiment will be described.

Figure 8:
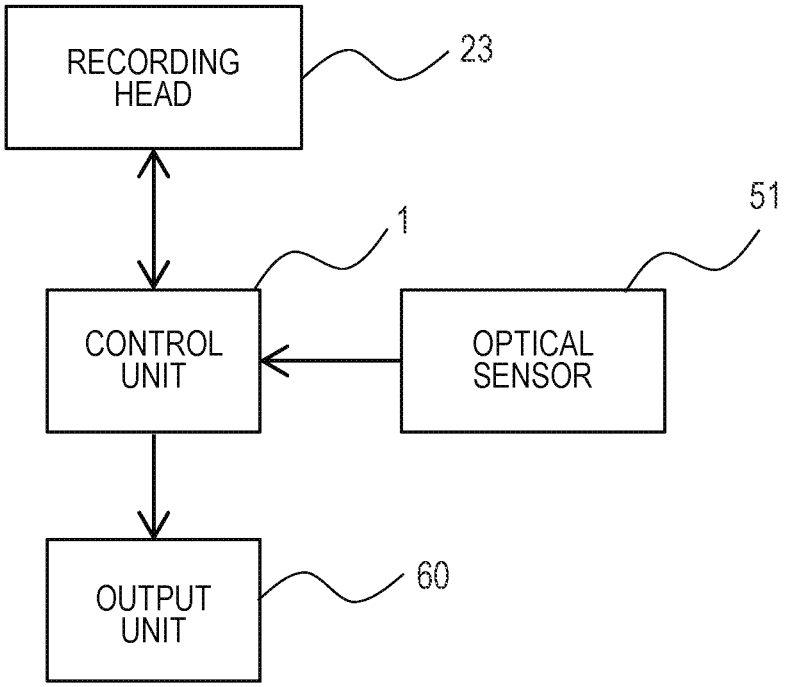
FIG. 8 is a block diagram showing a configuration of the portion related to control of the liquid detection operation.

FIG. 8 shows a configuration related to control of the liquid detection operation. The control unit 1 is a central processing unit (CPU) or the like. The control unit 1 receives the output signal of the optical sensor 51. The control unit 1 determines the storage state of the liquid in the ink tank 31 based on the output signal of the optical sensor 51. The output unit 60 outputs a signal such as a warning, for example, a signal requesting replacement of the ink cartridge 41. For example, the output unit 60 may display a message requesting replacement of the ink cartridge 41. Further, the output unit 60 may include a light emitter such as a light emitting diode (LED), and the light emitter may present a light emitting pattern for requesting replacement of the ink cartridge 41.

The control unit 1 controls the operation of the output unit 60 according to the liquid storage state. Specifically, when the output signal of the optical sensor 51 is in the ON state, the control unit 1 determines that the liquid in the ink tank 31 is low in amount, and causes the output unit 60 to output a signal requesting replacement of the ink cartridge 41. Hereinafter, the state of outputting a signal requesting replacement of the ink cartridge 41 is referred to as ink cartridge replacement request ON. Further, the state of not outputting a signal requesting replacement of the ink cartridge 41 is referred to as ink cartridge replacement request OFF.

Further, the control unit 1 controls the recording operation of the recording head 23. When the control unit 1 detects that the output signal of the optical sensor 51 is in the ON state, the control unit 1 determines whether the amount of liquid used in the ink tank 31 exceeds the specified amount. For example, the control unit 1 counts the number of times the droplets of the recording head 23 are ejected from the time when the output signal of the optical sensor 51 is turned ON. Here, the amount of droplet used in one ejection is known. Therefore, the amount of liquid used can be calculated based on the count value.

When the amount of liquid remaining in the ink tank 31 becomes small, there is a possibility that a problem may occur in the ejection operation of the recording head 23. The minimum amount of liquid remaining is predetermined so as not to cause a problem. The specified amount defines how much liquid can be used until the amount of liquid at the time when the output signal of the optical sensor 51 is turned ON reaches the minimum remaining amount. For example, the specified amount is given as a value obtained by subtracting the minimum remaining amount from the amount of liquid at the time when the output signal of the optical sensor 51 is turned ON.

Figure 9:
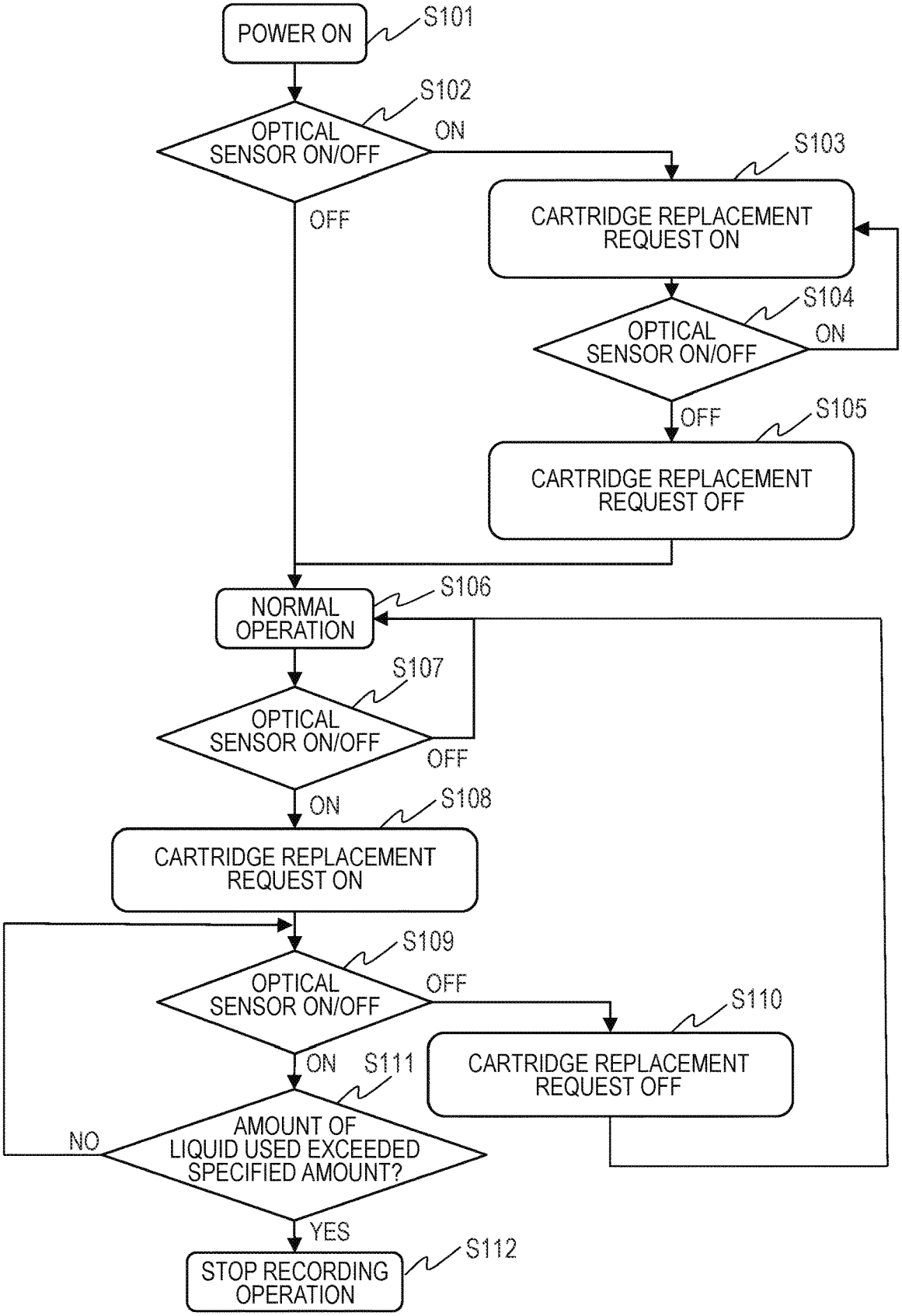
FIG. 9 is a flowchart showing the flow of the recording operation of the liquid ejection apparatus.

FIG. 9 shows the flow of the recording operation of the liquid ejection apparatus 10 of the present embodiment. In S101, the power of the liquid ejection apparatus 10 is turned ON. After the power is turned ON, in S102, the control unit 1 determines the ON/OFF state of the output signal of the optical sensor 51.

If the determination result of S102 is "ON," the control unit 1 sets the ink cartridge replacement request ON for the output unit 60 in S103. Subsequently, in S104, the control unit 1 determines the ON/OFF state of the output signal of the optical sensor 51. If the determination result of S104 is "ON," the process of S103 is executed again. If the determination result of S104 is "OFF," the control unit 1 sets the ink cartridge replacement request OFF for the output unit 60 in S105.

If the determination result of S102 is "OFF," or after executing the process of S105, the control unit 1 normally operates in S106. The normal operation includes the above-mentioned printing operation and the like.

During the normal operation, in S107, the control unit 1 determines the ON/OFF state of the output signal of the optical sensor 51. If the determination result of S107 is "OFF," the normal operation is maintained as it is. If the determination result of S107 is "ON," the control unit 1 sets the ink cartridge replacement request ON for the output unit 60 in S108. Subsequently, in S109, the control unit 1 determines the ON/OFF state of the output signal of the optical sensor 51.

If the determination result of S109 is "OFF," the control unit 1 sets the ink cartridge replacement request OFF for the output unit 60 in S110. After that, it returns to normal operation.

If the determination result of S109 is "ON," in S111, the control unit 1 determines whether the amount of liquid used from the time when the output signal of the optical sensor 51 is turned ON exceeds the specified amount. If the determination result of S111 is "NO," the determination returns to S109. If the determination result of S111 is "YES," the control unit 1 stops the operation of the recording head 23 in S112.

According to the liquid ejection apparatus of the present embodiment described above, the following operations and effects are obtained.

The first protrusion 42 of the ink cartridge 41 and the second protrusion 32 of the ink tank 31 are arranged between the light emitting section and the light receiving section. Therefore, the first protrusion 42 and the second protrusion 32 are arranged on the optical path 54 of the light emitted from the light emitting section. Thereby, a single detection unit (optical sensor 51) can detect the presence or absence of ink in the ink cartridge 41 and the ink tank 31. Moreover, since the presence or absence of ink in the ink cartridge 41 and the ink tank 31 can be detected with a single detection unit, it is possible to suppress the cost increase and the size increase of the liquid ejection apparatus.

Generally, in order to prevent erroneous insertion of the ink cartridge 41, the ink tank 31 is provided with a recess 31*a* for inserting the first protrusion 42 of the ink cartridge 41. In the present embodiment, it is possible to reduce the cost by utilizing the space of the recess 31*a* to arrange the optical sensor 51. In particular, as shown in FIG. 5, since the optical sensor 51 is a concave member, it can be easily stored in the recess 31*a*.

In addition, when the optical sensor 51 is stored in the recess 31*a* of the ink tank 31, it is appropriate to insert the first protrusion 42 of the ink cartridge 41 into the optical path 54 of the optical sensor 51 due to spatial restrictions. In the present embodiment, the space of the recess 31*a* can be made the minimum necessary size by inserting the first protrusion 42 into the optical path 54 of the optical sensor 51.

Further, in the configuration in which the first protrusion 42 of the ink cartridge 41 is inserted into the optical path 54 of the optical sensor 51, it is necessary to detect the presence or absence of the liquid in the ink tank 31 regardless of the presence or absence of the ink cartridge 41 and the state of the liquid in the ink cartridge 41. According to the present embodiment, regardless of whether or not the ink cartridge 41 is connected to the ink tank 31, and regardless of the amount of liquid remaining in the ink cartridge 41, it is possible to detect the presence or absence of the liquid in the ink tank 31 with a single optical sensor 51.

Note that if it is unnecessary to consider the spatial restrictions, the first protrusion 42 of the ink cartridge 41 may be moved out of the optical path 54 of the optical sensor 51. In this case, in the state where the ink cartridge 41 and the ink tank 31 are connected together, only the second protrusion 32 of the ink tank 31 is arranged on the optical path 54 of the optical sensor 51.

As described above, in the above description, an example is shown in which the detection light is blocked by ink when there is ink in either the first protrusion 42 or the second protrusion 32, but the present embodiment is not limited to this. That is, even if there is ink in, for example, the first protrusion 42, the detection light may be allowed to transmit through the first protrusion 42 and reach the light receiving section by increasing the light quantity of the detection light, for example. Then, only when there is ink in both the first protrusion 42 and the second protrusion 32, the detection light may be blocked by the ink so that it does not reach the light receiving section. As a result, the optical sensor 51 can output the output results in three stages depending on the state of the presence or absence of ink.

For example, when there is no ink in both the first protrusion 42 and the second protrusion 32, the light receiving section receives the largest light quantity, so that high is outputted. Then, when there is ink in either the first protrusion 42 or the second protrusion 32, the light quantity of light that reaches the light receiving section is somewhat reduced, so that the mid is outputted. When there is ink in both the first protrusion 42 and the second protrusion 32, the light does not reach the light receiving section, so that low is outputted. In this way, the output may be performed in three stages depending on the presence or absence of ink. This makes it possible to identify the state of presence or absence of ink in more detail. That is, when high is outputted, it is determined that there is no ink in both the first protrusion 42 and the second protrusion 32. When mid is outputted, it is determined that there is no ink in either the first protrusion 42 or the second protrusion 32. When low is outputted, it is determined that there is ink in both the first protrusion 42 and the second protrusion 32.

Second Embodiment

Next, the liquid ejection apparatus of the second embodiment of the present disclosure will be described. The liquid ejection apparatus of the present embodiment has basically the same configuration as the liquid ejection apparatus of the first embodiment except that the configuration of the liquid storage unit 13 is different. In order to avoid redundant description, a configuration different from that of the liquid ejection apparatus of the first embodiment will be described in detail here. In this embodiment, the liquid has a property of transmitting the detection light used by the optical sensor 51. Note that in the first embodiment, when the liquid surface level in the ink tank 31 was h3 or higher, the output signal of the optical sensor 51 was in the OFF state, and when the liquid surface level was less than h3, the output signal of the optical sensor 51 was in the ON state. In the present embodiment, when the liquid surface level in the ink tank 31 is h3 or higher, the output signal of the optical sensor 51 is turned ON, and when the liquid surface level is less than h3, the output signal of the optical sensor 51 is turned OFF.

Figure 10:
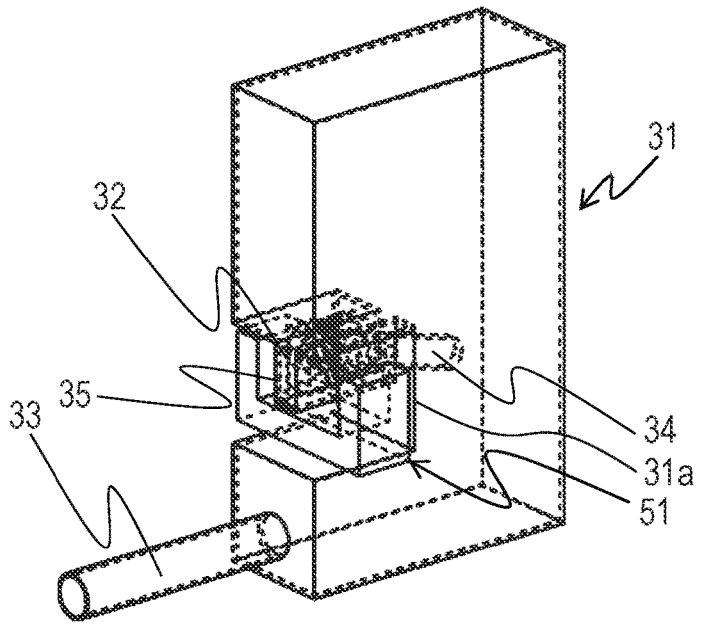
FIG. 10 is a perspective view schematically showing the configuration of an ink tank used in the liquid ejection apparatus of the second embodiment of the present disclosure.

FIG. 10 is a schematic view showing the configuration of the ink tank 31 used in the liquid ejection apparatus of the present embodiment. The ink tank 31 includes a recess 31*a*, a second protrusion 32, a flow path 33, a float plate 34, and a light blocking plate 35. The recess 31*a*, the second protrusion 32, and the flow path 33 are the same as those described in the first embodiment. The optical sensor 51 is stored in the recess 31*a*.

Figure 11A:
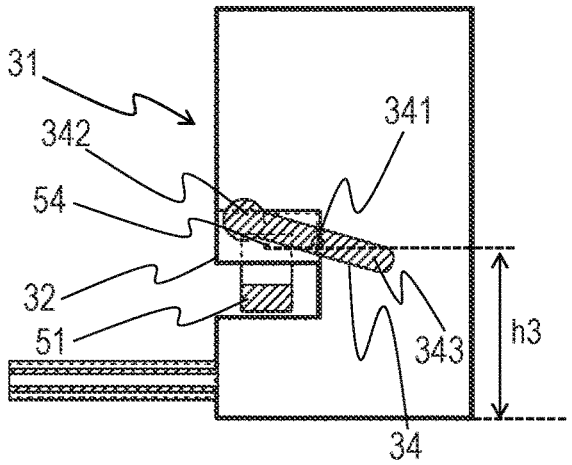
FIGS. 11A and 11B are each a schematic view for explaining a float plate.
Figure 11B:
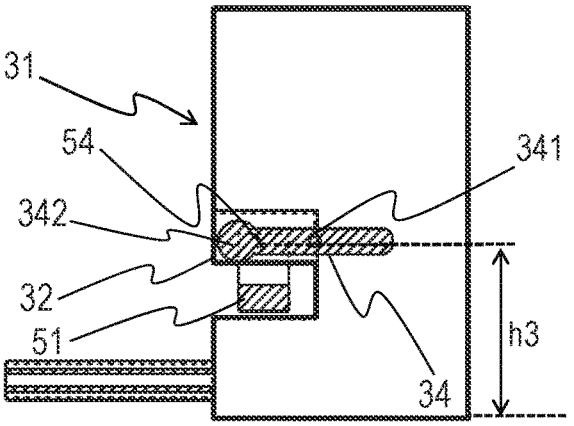

FIGS. 11A and 11B are each a schematic view for explaining the float plate 34. FIG. 11A shows a state where the float plate 34 is moved out of the optical path 54 of the optical sensor 51. FIG. 11B shows a state where the float plate 34 is inserted into the optical path 54 of the optical sensor 51.

As shown in FIGS. 11A and 11B, the float plate 34 includes a rotation center 341, an arm 343 extending from the rotation center 341, and a float portion 342 provided at a position away from the rotation center 341 of the arm 343. The float portion 342 is stored in the space of the second protrusion 32. The float plate 34 rotates about the rotation center 341. When there is a liquid in the second protrusion 32, the float portion 342 maintains a state of floating on the liquid surface in the second protrusion 32 by buoyancy. When there is no liquid in the second protrusion 32, the float portion 342 is placed in contact with the bottom in the second protrusion 32 by its own weight.

As shown in FIG. 11A, when the liquid surface level in the ink tank 31 is the height h3 or higher, the float portion 342 is located above the optical path 54 of the optical sensor 51. That is, the float plate 34 is in a state of rising to the left. Therefore, the float plate 34 is moved out of the optical path 54 of the optical sensor 51. In this case, the detection light passes through the second protrusion 32 and enters the light receiving section 53. The output signal of the optical sensor 51 is turned ON.

On the other hand, as shown in FIG. 11B, when the liquid surface level in the ink tank 31 is less than the height h3, the float portion 342 becomes the same height as the optical path 54 of the optical sensor 51. That is, the float plate 34 is in a horizontal state. Therefore, the float plate 34 is inserted into the optical path 54 of the optical sensor 51. In this case, the detection light is blocked by the float plate 34 and does not enter the light receiving section 53. The output signal of the optical sensor 51 is turned OFF.

The float plate 34 and the second protrusion 32 are an example of a light blocking unit capable of switching between a light blocking state of blocking the detection light emitted by the light emitting section 52 and a transmission state of transmitting the detection light. Here, the light blocking unit switches between the light blocking state and the transmission state according to the liquid surface level of the liquid in the ink tank 31.

Figure 12A:
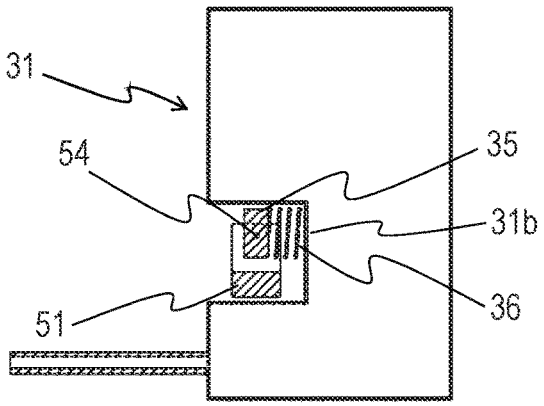
FIGS. 12A and 12B are each a schematic view for explaining a light blocking plate.
Figure 12B:
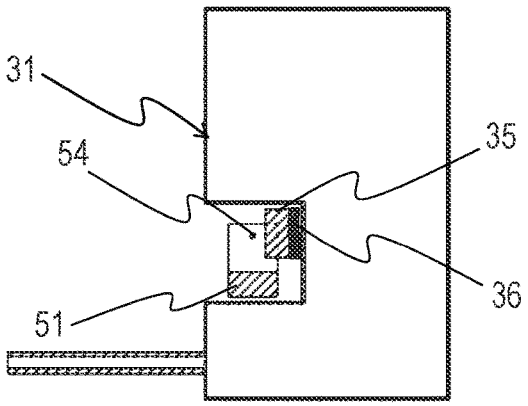

FIGS. 12A and 12B are each a view for explaining the light blocking plate 35. FIG. 12A shows a state where the light blocking plate 35 is not subjected to an external force. FIG. 12B shows a state where the light blocking plate 35 receives an external force and moves toward the inner surface of the recess 31*a*. Here, the external force is generated when the first protrusion 42 pushes the light blocking plate 35 when the ink cartridge 41 is connected to the ink tank 31.

As shown in FIGS. 12A and 12B, an elastic body 36 is provided at the facing portion 31*b* facing the first protrusion 42 on the inner surface of the recess 31*a*. The elastic body 36 is, for example, a spring member. The light blocking plate 35 is supported by the elastic body 36 so as to block the detection light traveling through the optical path 54 of the detection sensor 51.

As shown in FIG. 12A, the elastic body 36 is in an extended state when no external force is applied, and the light blocking plate 35 is arranged on the optical path 54 of the detection sensor 51. In this case, the detection light is blocked by the light blocking plate 35.

On the other hand, as shown in FIG. 12B, when the elastic body 36 contracts due to an external force, the light blocking plate 35 is moved out of the optical path 54 of the detection sensor 51. For example, with the ink cartridge 41 connected to the ink tank 31, the first protrusion 42 pushes the light blocking plate 35 toward the facing portion 31*b*. As a result, the light blocking plate 35 is moved out of the optical path 54 of the detection light. In this case, the detection light passes through the first protrusion 42.

Figure 13A:
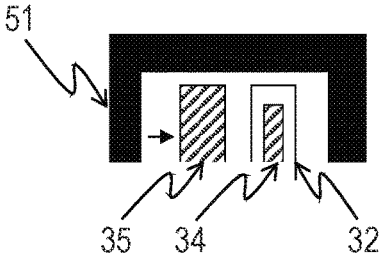
FIGS. 13A, 13B, and 13C are each a schematic view for explaining the passing and blocking states of the detection light in the optical sensor.
Figure 13B:
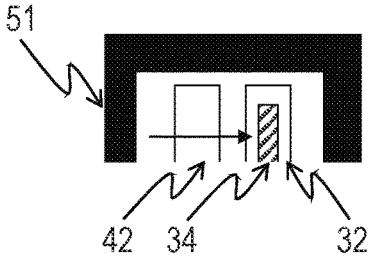
Figure 13C:
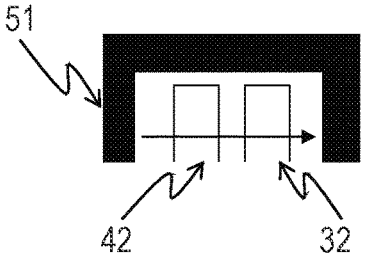

FIGS. 13A to 13C schematically show passing and blocking states of the detection light in the optical sensor 51. The operation of the optical sensor 51 will be described in detail below with reference to FIGS. 13A to 13C.

FIG. 13A shows a state where the ink cartridge 41 is not connected to the ink tank 31. Only the light blocking plate 35 and the second protrusion 32 are arranged in the optical path 54, and the first protrusion 42 of the ink cartridge 41 is not arranged. Since the liquid surface level in the ink tank 31 is less than h3, a float portion 342 of the float plate 34 is arranged inside the second protrusion 32 so as to block the detection light. In this case, the detection light emitted by the light emitting section 52 is blocked by the light blocking plate 35. Since the detection light does not enter the light receiving section 53, the optical sensor 51 outputs a signal indicating the OFF state.

FIG. 13B shows a state where the ink cartridge 41 is connected to the ink tank 31, and the second protrusion 32 of the ink tank 31 and the first protrusion 42 of the ink cartridge 41 are arranged in the optical path 54. Since the liquid surface level in the ink tank 31 is less than h3, the float plate 34 is arranged in the second protrusion 32 so as to block the detection light. In this case, the detection light emitted by the light emitting section 52 passes through the first protrusion 42 and is then blocked by the float plate 42. Since the detection light does not enter the light receiving section 53, the optical sensor 51 outputs a signal indicating the OFF state.

FIG. 13C shows a state where the ink cartridge 41 is connected to the ink tank 31, and the second protrusion 32 of the ink tank 31 and the first protrusion 42 of the ink cartridge 41 are arranged in the optical path 54. Since the liquid surface level in the ink tank 31 is h3 or more, the float plate 34 is moved out of the optical path 54 in the second protrusion 32. In this case, the detection light emitted by the light emitting section 52 passes through the first protrusion 42 and the second protrusion 32 in order. Since the detection light enters the light receiving section 53, the optical sensor 51 outputs a signal indicating the ON state.

Next, the liquid detection operation of the liquid ejection apparatus of the present embodiment will be described. Note that in the first embodiment, when the liquid surface level in the ink tank 31 was h3 or higher, the output signal of the optical sensor 51 was in the OFF state, and when the liquid surface level was less than h3, the output signal of the optical sensor 51 was in the ON state. On the other hand, in the present embodiment, when the liquid surface level in the ink tank 31 is h3 or higher, the output signal of the optical sensor 51 is turned ON, and when the liquid surface level is less than h3, the output signal of the optical sensor 51 is turned OFF. Further, even when the liquid surface level in the ink tank 31 is h3 or higher, the output signal of the optical sensor 51 is turned OFF when the light blocking plate 35 is inserted into the optical path 54. Then, when the light blocking plate 35 is moved out of the optical path 54, the output signal of the optical sensor 51 is turned ON. Therefore, in the present embodiment, the determination of ON/OFF of the output signal of the optical sensor 51 is different from that of the first embodiment.

Figure 14:
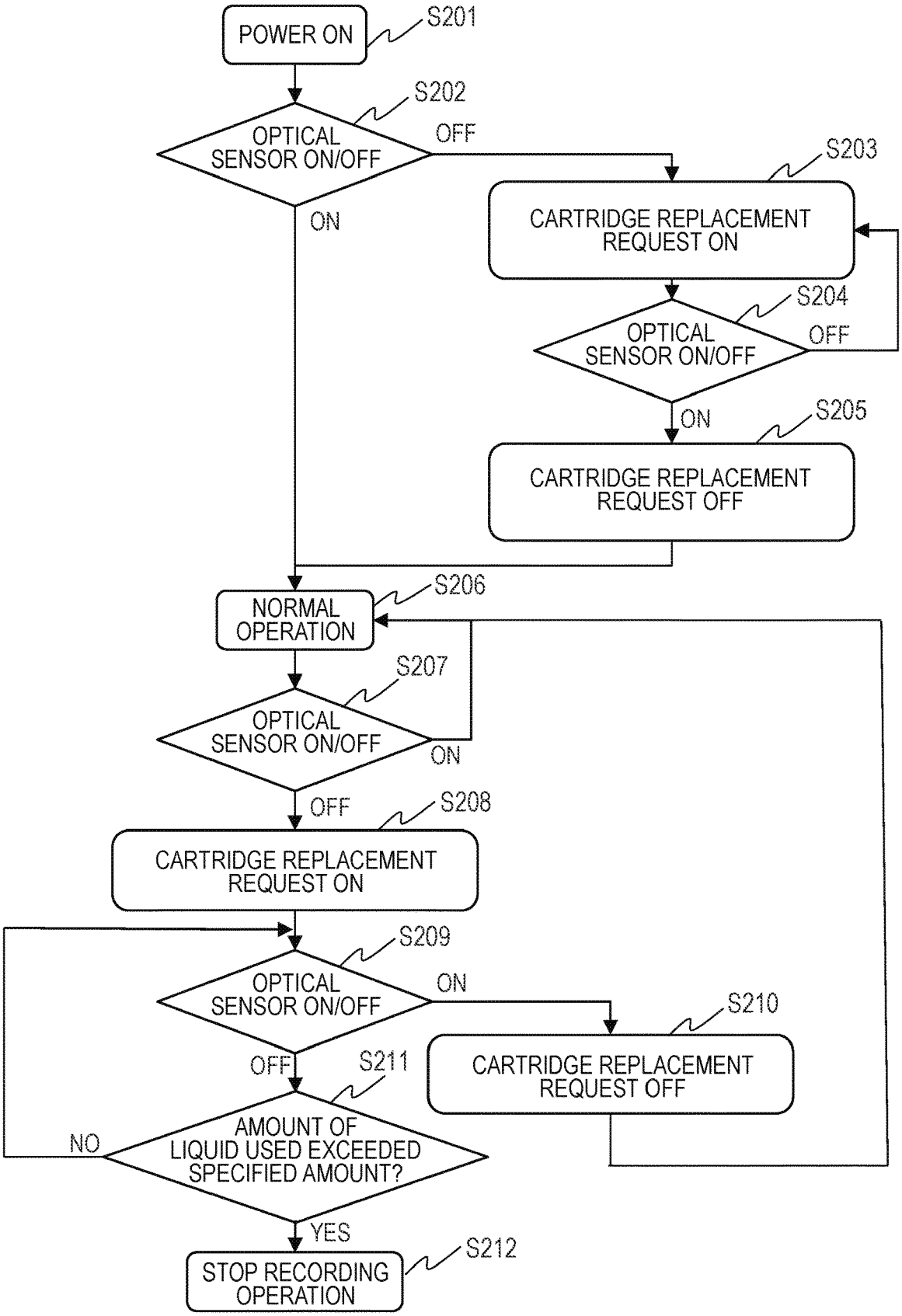
FIG. 14 is a flowchart showing the flow of the recording operation of the liquid ejection apparatus.

FIG. 14 shows the flow of the recording operation of the liquid ejection apparatus 10 of the present embodiment. In S201, the power of the liquid ejection apparatus 10 is turned ON. After the power is turned ON, in S202, the control unit 1 determines the ON/OFF state of the output signal of the optical sensor 51.

If the determination result of S202 is "OFF," the control unit 1 sets the ink cartridge replacement request ON for the output unit 60 in S203. Subsequently, in S204, the control unit 1 determines the ON/OFF state of the output signal of the optical sensor 51. If the determination result of S204 is "OFF," the process of S203 is executed again. If the determination result of S204 is "ON," the control unit 1 sets the ink cartridge replacement request OFF for the output unit 60 in S205.

When the determination result of S202 is "ON," or after executing the process of S205, the control unit 1 normally operates in S206. The normal operation includes the above-mentioned recording operation and the like.

During the normal operation, in S207, the control unit 1 determines the ON/OFF state of the output signal of the optical sensor 51. If the determination result of S207 is "ON," the normal operation is maintained as it is. If the determination result of S207 is "OFF," the control unit 1 sets the ink cartridge replacement request ON for the output unit 60 in S208. Subsequently, in S209, the control unit 1 determines the ON/OFF state of the output signal of the optical sensor 51.

If the determination result of S209 is "ON," the control unit 1 sets the ink cartridge replacement request OFF for the output unit 60 in S210. After that, it returns to normal operation.

If the determination result of S209 is "OFF," in S211 the control unit 1 determines whether the amount of liquid used from the time when the output signal of the optical sensor 51 is turned OFF exceeds the specified amount. If the determination result of S211 is "NO," the determination returns to S209. If the determination result in S211 is "YES," the control unit 1 stops the operation of the recording head 23 in S212.

The liquid ejection apparatus of the present embodiment described above also has the same operations and effects as those of the first embodiment.

In addition, when the ink cartridge 41 is not connected to the ink tank 31, the detection light emitted by the light emitting section 52 is blocked by the light blocking plate 35 (see FIG. 13A), so that the output signal of the optical sensor 51 is always in the OFF state. As a result, the output unit 60 always outputs a replacement request for the ink cartridge 41. By providing the light blocking plate 35 in this way, it is possible to output a replacement request in the absence of the ink cartridge 41.

When the user connects the ink cartridge 41 to the ink tank 31 in response to the replacement request, the light blocking plate 35 is moved out of the optical path 54 (see FIG. 13B), and the liquid is supplied from the ink cartridge 41 to the ink tank 31. As a result, the float portion 342 in the second protrusion 32 is moved out of the optical path 54, the detection light enters the light receiving section 53, and the output signal of the optical sensor 51 is switched from the OFF state to the ON state as shown in FIG. 13C.

Note that the present embodiment is not limited to the above embodiment. As described in the first embodiment, the output result of multiple stages may be outputted from the optical sensor. The light quantity from the light emitting section 52 is appropriately set so that the detection light reaches the light receiving section 53 even when, for example, there is ink in both the first protrusion 42 and the second protrusion 32. Then, the detection light can be prevented from reaching the light receiving section 53 only when the float plate 34 blocks the detection light. In this way, it is possible to make determinations in four stages: (1) when there is no ink both in the first protrusion 42 and in the second protrusion 32, (2) when there is no ink only in the first protrusion 42, (3) when there is no ink in at least the second protrusion 32, and (4) when there is ink in both the first protrusion 42 and the second protrusion 32.

Further, the float plate 34 may be provided in the first protrusion 42. Alternatively, the float plate 34 may be provided both in the first protrusion 42 and in the second protrusion 32. As a result, it is possible to appropriately change what can be determined, and it becomes possible to detect the presence or absence of ink in more detail.

The present disclosure makes it possible to detect the presence or absence of ink in both the ink tank and the ink cartridge with a single detection unit. As a result, it is possible to suppress the cost increase and the size increase of the liquid ejection apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-172977, filed Oct. 14, 2020, and Japanese Patent Application No. 2021-126678, filed Aug. 2, 2021, which are hereby incorporated by reference herein in their entirety.

What is claimed is:

1. A liquid ejection apparatus comprising:

an ink cartridge including a first ink storage section which stores ink;

an ink tank including a second ink storage section which is connected to the ink cartridge and supplied with ink from the ink cartridge; and a detection unit including a light emitting section which emits detection light and a light receiving section which receives the detection light, wherein the ink cartridge includes a first protrusion in communication with the first ink storage section, the ink tank includes a recess and a second protrusion in communication with the second ink storage section, the light emitting section and the light receiving section are arranged in the recess, and the first protrusion and the second protrusion are arranged between the light emitting section and the light receiving section.

2. The liquid ejection apparatus according to claim 1, wherein the detection light fails to reach the light receiving section when a liquid surface level of a liquid is a predetermined height or higher, and reaches the light receiving section when the liquid surface level of the liquid is less than the predetermined height.

3. The liquid ejection apparatus according to claim 1, wherein the first protrusion is a part of the ink cartridge.

4. The liquid ejection apparatus according to claim 1, wherein the second protrusion is a part of the ink tank.

5. The liquid ejection apparatus according to claim 1, wherein the ink tank includes a float plate provided with a rotation center, an arm extending from the rotation center, and a float portion provided at a position away from the rotation center of the arm, the float portion is arranged inside the second protrusion, and the float plate rotates about the rotation center according to a liquid surface level of a liquid.

6. The liquid ejection apparatus according to claim 5, wherein if the liquid surface level of the liquid is less than a predetermined height, the float plate blocks the detection light, and if the liquid surface level of the liquid is the predetermined height or higher, the float plate is moved out of an optical path of the detection light.

7. The liquid ejection apparatus according to claim 1, further comprising:

an elastic body provided at a facing portion facing the first protrusion on an inner surface of the recess; and a light blocking plate supported by the elastic body so as to block an optical path of the detection light, wherein with the ink cartridge and the ink tank connected together, the first protrusion pushes the light blocking plate toward the facing portion, and the light blocking plate is moved out of the optical path of the detection light.

8. The liquid ejection apparatus according to claim 1, wherein the first protrusion is transparent to the detection light and is inserted into an optical path of the detection light.

9. The liquid ejection apparatus according to claim 1, wherein the second protrusion is transparent to the detection light and is inserted into an optical path of the detection light.

10. The liquid ejection apparatus according to claim 1, wherein the detection unit is a concave member which includes a first side surface provided with the light emitting section and a second side surface facing the first side surface and provided with the light receiving section, and the concave member is disposed in the recess of the ink tank.

* * * * *